United States Patent [19]

DeGelder

[11] Patent Number: 5,066,069

[45] Date of Patent: Nov. 19, 1991

[54] CHAIR BACK AND SEAT ADJUSTMENT MECHANISM

[75] Inventor: Jacob DeGelder, San Pedro, Calif.

[73] Assignee: Systems Furniture Company, Torrance, Calif.

[21] Appl. No.: 518,378

[22] Filed: May 3, 1990

[51] Int. Cl.[5] ..... A47C 1/024

[52] U.S. Cl. ..... 297/374; 297/306; 297/328

[58] Field of Search ..... 297/325-328, 297/374-376, 378, 306; D6/500

[56] References Cited

U.S. PATENT DOCUMENTS

| | | | |
|---|---|---|---|
| D. 290,073 | 6/1987 | Doerner | D6/500 |
| D. 292,459 | 10/1987 | Doerner | D6/500 |
| 3,720,443 | 3/1973 | Mourgue | 297/353 X |
| 4,198,094 | 4/1980 | Bjerknes et al. | 297/328 |
| 4,392,686 | 7/1983 | Beer | 297/376 |
| 4,478,454 | 10/1984 | Faiks | 297/328 |
| 4,636,004 | 1/1987 | Neumüller | 297/306 X |
| 4,693,514 | 9/1987 | Völkle | 297/374 |
| 4,718,725 | 1/1988 | Suhr et al. | 297/326 |
| 4,916,968 | 4/1990 | Kabaya | 297/306 X |

*Primary Examiner*—Kenneth J. Dorner
*Assistant Examiner*—Cassandra Hope
*Attorney, Agent, or Firm*—Pennie & Edmonds

[57] ABSTRACT

A chair having a seat and back adjustment mechanism in which a single handle is operable to hold or release both the seat and the back at selected independent angles. A bank of plates serving the seat and a bank of plates serving the back are interleaved and positioned to be compressed by the handle.

4 Claims, 2 Drawing Sheets

CHAIR BACK AND SEAT ADJUSTMENT MECHANISM

BACKGROUND OF THE INVENTION

Chair back adjustment devices using a series of engaging plates and a clamp are old (U.S. Pat. No. 4,062,587) and chair seat adjustments using a threaded stem have also been proposed (U.S. Pat. No. 3,712,672).

SUMMARY OF THE INVENTION

Broadly, the present invention comprises a chair adjustment mechanism having an elongated horizontal pedestal supported frame which frame remains in its horizontal position during chair operation. Pivotally mounted on the frame is a chair seat support and also pivotally mounted on the frame is a back bracket for supporting a back rest. A set of slotted plates are mounted on the frame and a second set on the back bracket. The tilt of the back and seat is controlled by a locking stem passing through the slots of both sets of plates.

It is a feature of the invention that both seat and back tilts can be selected by the chair operators and such positions maintained by operating a single control handle.

DESCRIPTION OF THE PREFERRED EMBODIMENT

Figure 1:
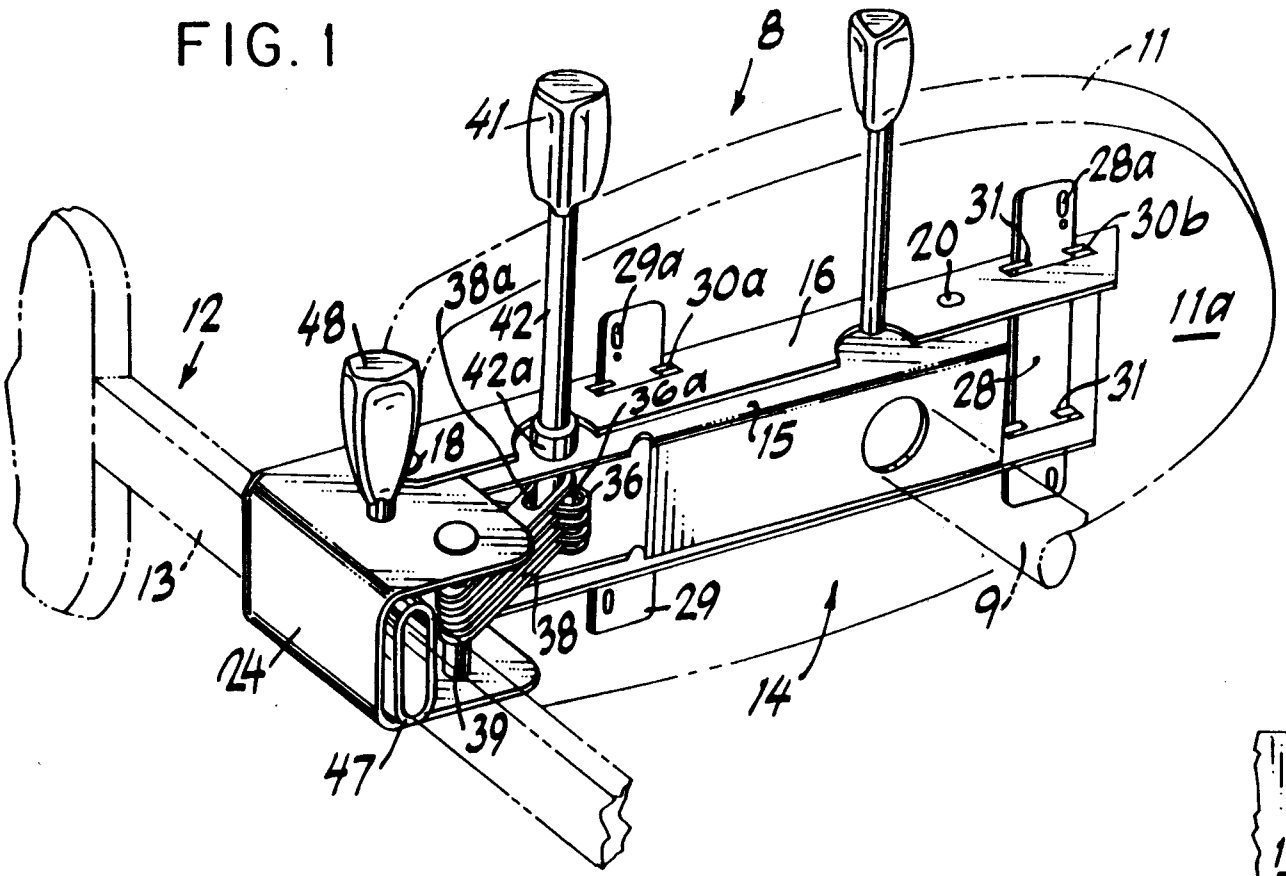
FIG. 1 is a perspective view of the chair adjustment mechanism seen from the bottom.

In the drawings, chair 8 with pedestal 9 (partially) shown includes oval seat 11 with seat bottom 11*a*, back 12, back support post 13 and seat and back adjustment mechanism 14.

Adjustment mechanism 14 includes pedestal horizontal frame piece 15 which remains in a substantially horizontal position throughout operation of chair 8. Pivotal seat support housing 16 which pivots about pin 20 mounted in frame piece 15 with seat-bottom-engagement piece 17 and spaced-apart vertical pieces 19 (at the right side as viewed by the person sitting in chair 8) and piece 21 on the left side. Pieces 17, 19 and 21 form a U-shape in cross-section and preferably are integrally formed.

Frame piece 15 supports a back bracket 24 pivotal about pin 18. Pedestal post 9 is raised by operation of control handle 26 employing a hydraulic arrangement (not shown). Seat support housing 16 is secured to seat bottom 11*a* of seat 11 with forward cross mount plate 28 and rearward cross mount plate 29. Notches 31 in plates 28, 29 interlock with indentations 17*a* in seat-bottom-engagement piece 17 (see FIG. 4).

Also pivotal about pin 18 of seat support housing 16, is a bank or set of seat friction plates 36. A second set of back friction plates 38 are mounted on pin 39 of back bracket 24. Both sets of friction plates 36, 38 have slots 36*a*, 38*a*. The sets of friction plates 36, 38 are interleaved and are compressed by adjustment control handle 41 having threaded stem 42. Stem 42 carries limit ring 42*a*. Handle 41 is mounted parallel to pins 18 and 39 and carries a threaded portion to permit urging the sets of plates 36, 38 together in lock position or releasing the plates for adjustment.

Figure 4:
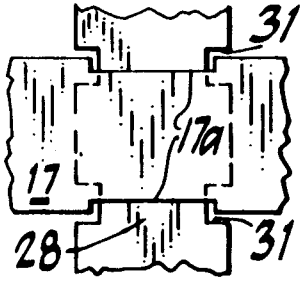
FIG. 4 is a partial top view of the mechanism seat support housing and its seat mount cross plates.
Figure 2:
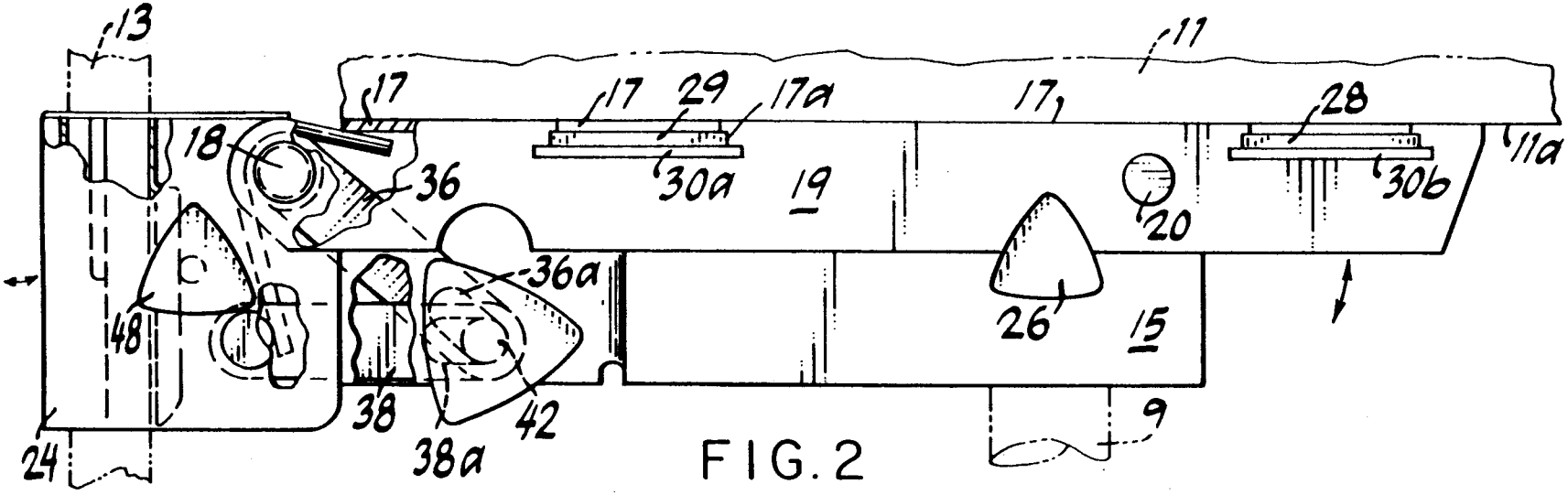
FIG. 2 is a partial side elevational view of the mechanism.
Figure 3:
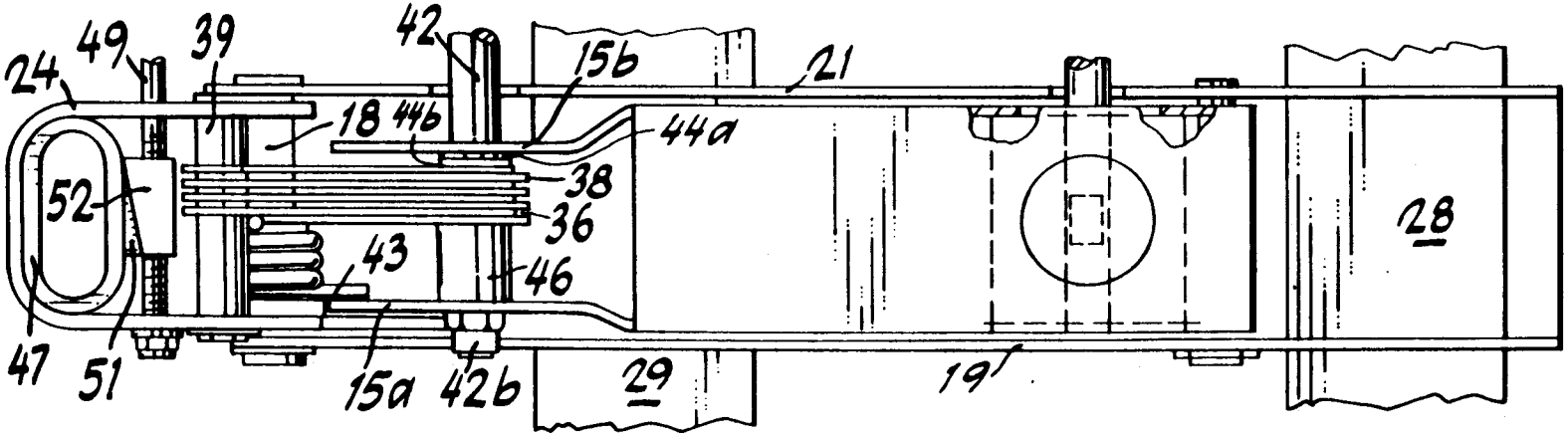
FIG. 3 is a bottom view of the mechanism.

Turning to FIGS. 2, 3 and 4, spring 43 urges back bracket 24 to a position in which back friction plates 38 move left in FIG. 2 until the end of slot 38*a* engages stem 42. In that position, back post 13 is angled from the vertical position toward a person sitting in the chair. FIG. 2 shows the back post 13 urged against spring 43 to the vertical position. Stem 42 of handle 41 carries washers 44*a*, 44*b*, and collar 46 and stem nut 42*b* along with both sets of friction plates 36, 38. The washers 44*a*, 44*b*, collar 46, and plates 36, 38 are confined between frame sides 15*a*, 15*b* for tightening and relaxation (FIG. 3). The tightening of plates 36, 38 is accomplished by turning handle 41 which turns stem 42, which through its threaded end causes threaded nut 42*b* held against turning in a recess in vertical piece 19, to translate along stem 42 toward handle 41. As nut 42*b* moves in this direction it urges collar 46 against plates 36, 38 which plates are confined by washers 44*a*, 44*b*. Relaxation of plates 36, 38 is accomplished by turning stem 42 in the opposite direction.

Back post 13 is adjustable up or down as housed in oval plastic grip piece 47. Grip piece 47 has a wedge section 51 attached, which complements the angle of metal wedge piece 52 which slides back and forth on stem 49. Depending on the way knob 48 on stem 49 is rotated, it will increase or decrease pressure against back post 13 positioned in piece 47 so that back assembly 12 is locked in place or released at will. Back assembly 12 with post 13 moves up or down for adjustment of back to correct height. Threaded stem 49 carries back adjustment handle 48.

Turning to FIGS. 3 and 4, cross plates 28, 29 are slidable for assembly purposes through rectangular seat support openings 30*a*, 30*b* in each side of the sides 19, 21 of chair support housing 16. Plates 28, 29 are inserted until their indentation notches 31 match seat support notches 17*a* permitting plates 28, 29 to be moved upwardly notches until indentations 17*a* and notches 31 interlock (FIG. 4). In this position, cross plates 28, 29 are below but touching the underside of piece 17. In this position, plates 28, 29 are screwed, bolted or otherwise secured to seat bottom 11*a*. Piece 17, as held against seat bottom by fasteners through holes 28*a*, 29*a*, cannot move in any direction.

To accomplish dual adjustment of seat and back (or if only one adjustment is desired), adjustment handle 41 is turned to release the banks of friction plates 36, 38 and permit the seat housing 16 and back bracket 24 to be moved to any angular position vis-a-vis frame 15 consistent with the length of the slots 36*a*, 38*a* and cross-sectional size of stem 42 therein. As the plates move about their pivots control handle 41, mounted in frame 15, remains in the slots 36*a*, 38*a*. Once the seat 11 and back 12 are at the desired angles, control handle 41 including its stem 42 is turned to tighten the plates 36, 38 together until they are tight enough that normal chair use will not exert forces which permit sliding movement between or among the plates 36, 38. The height of back post 13 is then, optionally, also adjustable as described above.

What is claimed is:

1. A chair adjustment mechanism for use with a chair having a seat, a back and a pedestal comprising a) an elongated frame mounted on the pedestal in a manner to hold such frame in a substantially horizontal plane;

b) a seat support piece pivotally mounted about a first horizontal pivot pin on the frame;

c) a back bracket mounted about a second horizontal pivot pin on the seat support piece;

d) a first set of friction plates having elongated slots therein mounted to the second pivot;

e) a second set of friction plates having elongated slots therein mounted to a third horizontal pivot pin on the back bracket; and f) a horizontal adjustment handle mounted through the frame and the slots of such sets of plates which first friction plate slots are aligned with one another and said second friction plate slots are aligned with one another while each such slot set is at an angle to the other slot set and such adjustment handle is rotatable to compress the plates together in lock position whereby the seat and back are adjustable about spaced apart pivot pins and each is capable of being held in selected independent orientations with the horizontal frame.

2. The chair mechanism of claim 1 in which back height is adjustable.

3. The chair mechanism of claim 1 in which the seat support piece is held to the seat utilizing cross piece plates which interlock therewith.

4. The chair mechanism of claim 1 in which a back post passes through said back bracket having a plastic grip piece with wedge means mounted on a rotatable means for translating said wedge means to flex and urge the grip piece against the post for holding the post in a selected position.

* * * * *